US005117625A

United States Patent [19]

McArthur et al.

[11] Patent Number: 5,117,625

[45] Date of Patent: Jun. 2, 1992

[54] INTEGRATED BLEED LOAD COMPRESSOR AND TURBINE CONTROL SYSTEM

[75] Inventors: Malcolm McArthur, Escondido; Colin Rodgers, San Diego, both of Calif.

[73] Assignee: Sundstrand Corporation, Rockford, Ill.

[21] Appl. No.: 655,082

[22] Filed: Feb. 14, 1991

Related U.S. Application Data

[63] Continuation-in-part of Ser. No. 447,179, Dec. 7, 1989, which is a continuation-in-part of Ser. No. 197,626, May 23, 1988, Pat. No. 4,989,403.

[51] Int. Cl.[5] ..... F02C 9/16

[52] U.S. Cl. ..... 60/39.07; 60/39.29

[58] Field of Search ..... 60/39.07, 39.23, 39.27, 60/39.29, 726; 415/26, 27, 28, 160, 163, 199.1

[56] References Cited

U.S. PATENT DOCUMENTS 2,625,009 1/1953 Leggett et al. ..... 60/726
2,817,475 12/1957 Moody ..... 415/160
3,659,417 5/1972 Grieb ..... 60/39.113
4,091,613 5/1978 Young ..... 60/39.07
4,370,560 1/1983 Faulkner et al. .
4,809,497 3/1989 Schuh .
4,813,226 3/1989 Grosselfiner et al. .

*Primary Examiner*—Louis J. Casaregola
*Attorney, Agent, or Firm*—Wood, Phillips, VanSanten, Hoffman & Ertel

[57] ABSTRACT

Unstable operation of a gas turbine engine subject to variable shaft loading and bleed air loading may be avoided in a gas turbine (12, 22, 40) having first and second stage compressors (12, 22) on a common shaft (10) with a turbine wheel (40) and by providing the inlet (14) to the first stage compressor (12) with variable inlet guide vanes (16). Bleed air flow is controlled by a bleed air valve (60) connected to the interface (24) of the first stage compressor outlet (18) and the second stage compressor inlet (20). A controller (66) is operative to control the position of the inlet guide vane (16) in response to bleed air flow sensed by a sensor (58).

8 Claims, 2 Drawing Sheets

INTEGRATED BLEED LOAD COMPRESSOR AND TURBINE CONTROL SYSTEM

CROSS REFERENCE

This application is a continuation-in-part of commonly assigned application Ser. No. 447,179 filed Dec. 7, 1989 and entitled "Surge Protected Gas Turbine Engine For Providing Variable Bleed Air Flow" which, in turn, is a continuation-in-part of commonly assigned, co-pending application Ser. No. 197,626 filed May 23, 1988 (U.S. Pat. No. 4,989,403), also entitled "Surge Protected Gas Turbine Engine For Providing Variable Bleed Air Flow".

FIELD OF THE INVENTION

This invention relates to a gas turbine, and more particularly, to a gas turbine that is utilized to provide a substantial quantity of bleed air to satisfy a varying demand therefore as well as to drive a variable load and a control system therefore.

BACKGROUND OF THE INVENTION

Gas turbine engines are utilized for a large variety of purposes including propulsion by thrust, propulsion by mechanical coupling, driving accessories requiring a rotary input, providing compressed air, and combinations thereof. The compressed air provided may be taken from a load compressor driven by the turbine or as bleed air. The latter is known as "bleed air" because it is bled from the turbine engine at some location following partial or total compression by a rotary or centrifugal compressor utilized in such engines to compress air to be used to sustain combustion. Bleed air may be utilized for a variety of purposes. For example, in an aircraft, it may be utilized for cabin ventilation, deicing, driving an air motor for starting main propulsion engines, and the like.

In any event, many of the uses to which bleed air is put are variable in the sense that the quantity of bleed air required for a given use will vary over a period of time. At the same time, the demand for air to support combustion for operation of the turbine engine will be more constant although it, also, may vary dependent upon the load placed on the engine where the engine is mechanically coupled to a pump or a generator or the like.

As a consequence, a decrease in the demand for bleed air, without more, can result in so-called compressor surge or back flow that will occur because of the presence of a higher pressure in the combustor for the engine than in the diffuser for the combustor. As is well-known, surge is highly undesirable as it causes unstable operation of the turbine engine and can cause substantial damage to compressor components.

To avoid this difficulty, the prior art has resorted to the use of, for example, surge protection valves which are operable to open a flow path through which bleed air in excess of that demanded (sometimes referred to as "excess pneumatic load") at a particular time may be dumped to prevent compressor surge. This method of providing surge protection is satisfactory in preventing surge from occurring, but requires that the turbine engine operate for a greater period of time at or near a full load condition. The relatively high loading that results reduces engine life and in addition, consumes unnecessarily large quantities of fuel.

In the above-identified applications, the disclosures of which are herein incorporated by reference, a gas turbine engine having unique characteristics allowing the same to provide variable amounts of bleed air while avoiding surge related problems is disclosed. In particular, the above-identified applications disclose a gas turbine engine wherein the load compressor is integrated into the engine so that the engine has first and second rotary compressors which are driven by a turbine wheel. Bleed air is taken between the interface of the first and second stage compressors and variable inlet guide vane geometry is employed at the inlet of the first stage compressor. In addition, the first stage compressor is a so-called high specific speed compressor. High specific speed ($N_s$) is equal to or greater than about 100 where it is defined as $$N_s = \frac{N\sqrt{CFS}}{(H_{ad})^{.75}}$$

and N=rpm of the first stage compressor,

CFS=first stage compressor inlet volumetric flow rate in $ft^3$/second, and $H_{ad}$=adiabatic head in ft.

In addition, it is preferable that the first stage compressor have an impeller blade tip angle greater than zero degrees from the radial direction and be followed by a vaned diffuser in the first stage compressor outlet.

As pointed out in the above-identified applications, it is possible to operate such a gas turbine engine on the stable side of the surge line simply by varying the inlet guide vane geometry appropriate to bleed air flow allowing the turbine to be fueled only as required to meet the actual demand for power. Consequently, the problem of surge is minimized or eliminated altogether while fuel consumption is reduced as is engine loading. In short, the gas turbine engine disclosed in the above-identified applications provide surge protection without wasteful dumping of excess bleed air and/or operation near or at full load conditions.

The present invention is directed to providing an optimized control system for such an engine.

SUMMARY OF THE INVENTION

It is the principal object of the invention to provide a new and improved gas turbine engine which is ideally suited for providing variable quantities of bleed air as well as for mechanical coupling to a varying load. More particularly, it is an object of the invention to provide a new and improved control system for such a gas turbine engine.

An exemplary embodiment of the invention achieves the foregoing objects in a construction including a turbine engine adapted to be coupled to a load and including interconnected first and second stage compressors. A turbine wheel is connected in driving relation to the compressors and an exhaust extends from the turbine wheel. A combustor is interposed between the turbine wheel and the second stage combustor and variable inlet guide vanes are located at the inlet to the first stage compressor.

Means are provided to define a controllable bleed air flow path connected between the first and second compressors which includes a bleed air flow sensor. A fuel system including a fuel flow control is provided for providing fuel to the combustor to be combusted therein and a turbine wheel speed sensor is connected to the turbine engine. Means are provided for moving the inlet guide vanes between open, closed and intermediate positions and means are provided for sensing the positions of the inlet guide vanes and for providing a signal representative thereof. Means are additionally provided for generating a variable bleed air signal to command varying bleed air flows. Means are provided which are responsive to the bleed air signal for operating the controllable bleed air flow path to provide the commanded varying bleed air flows. Finally, there is provided a means which is responsive to the bleed air flow sensor for causing the moving means to move the inlet guide vanes between the positions thereof to prevent surge in response to decreases in bleed air flow.

In a preferred embodiment of the invention, the bleed air flow path includes a modulating valve and further includes rate limiting means for preventing the modulating valve from closing at a rate faster than the moving means can move the inlet guide means to a corrected position for the resulting change in bleed air flow.

An embodiment of the invention contemplates an exhaust gas sensor associated with the exhaust for providing an exhaust gas temperature signal and contemplates that the means for operating the controllable bleed air flow path be responsive to the exhaust gas temperature signal as well as to the bleed air demand signal.

In one embodiment of the invention, the bleed air flow path includes a modulating valve as mentioned previously and the means for operating the controllable bleed air flow path includes a position feedback servo loop connected to the modulating valve.

Preferably, the first stage compressor is a high specific speed compressor. In a highly preferred embodiment, the high specific speed is equal to or greater than about 100 and is defined as set forth previously.

According to another facet of the invention, there is provided an integrated bleed load compressor and turbine system which includes a rotatable shaft adapted to drive a variable load. The high specific speed first stage centrifugal compressor is disposed on the shaft and a second stage compressor is located on the shaft and has an inlet connected to the outlet of the first stage compressor to define an interface. A modulating bleed air valve, including an actuator, is connected to the interface and variable inlet guide vanes are located at the inlet to the first stage compressor. A combustor is connected to the outlet of the second stage compressor and includes a fuel inlet to receive fuel to be combusted. A turbine wheel is disposed on the shaft and is located to receive hot gases of combustion from the combustor. An exhaust is provided for the turbine wheel and means are provided for driving the inlet guide vanes between open, closed and intermediate positions and for providing an inlet guide vane position feedback signal.

Means are associated with the exhaust for providing an exhaust gas temperature signal and means are provided for generating a bleed air demand signal. Means are also provided for generating a bleed air modulating valve position feedback signal along with a bleed air valve servo control for the actuator which is responsive to the exhaust gas temperature, bleed air demand and modulating valve position feedback signals for controlling operation of the actuator to place the modulating valve in the desired condition.

Also included is a bleed air flow sensor for sensing bleed air flow through the modulating valve and providing a bleed air flow signal along with an inlet guide vane servo control for the driving means which is responsive to the inlet guide vane position feedback, bleed air demand and bleed air flow signals for placing the inlet guide vanes in the desired position thereof.

Preferably, the system includes a means for conditioning both of the servo controls for system start and system ready to load conditions.

In a preferred embodiment, a gating system is included in the bleed air valve servo control which includes a rate limiting circuit for limiting the rate of which the bleed air valve may be modulated.

Other objects and advantages will become apparent from the following specification taken in connection with the accompanying drawings.

DESCRIPTION OF THE PREFERRED EMBODIMENT

Figure 1:
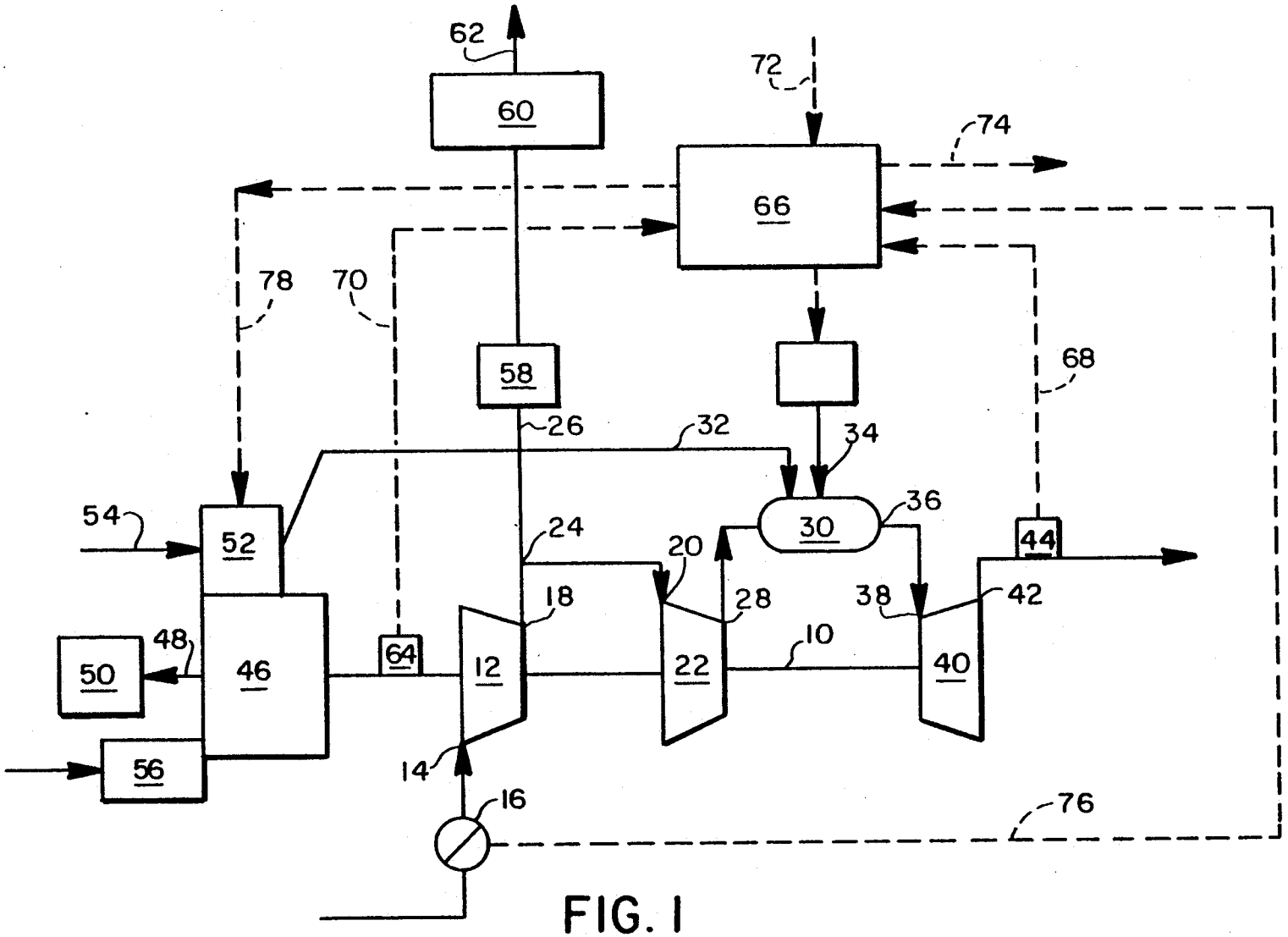
FIG. 1 is a schematic view of a turbine engine and control system made according to the invention.

An exemplary embodiment of a gas turbine engine made according to the invention is illustrated somewhat schematically in FIG. 1 and is seen to include a rotatable shaft 10 journaled by any suitable means for rotation about an axis. A first stage centrifugal compressor 12. is mounted on the shaft 10 for rotation therewith. Preferably, the first stage compressor 12 is a high specific speed compressor, having a high specific speed of about 100 or more where high specific speed is defined as set forth previously. Preferably, the first stage compressor 12 will have other characteristics as well which are described in the previously identified co-pending applications.

An inlet 14 is shown for the first stage compressor 12 and is provided with variable inlet guide vanes 16 which may be of conventional construction.

The outlet 18 of the first stage compressor is connected via a vaned diffuser (not shown) to the inlet 20 of a second stage, centrifugal compressor 22 which is also mounted on the shaft 10 for rotation therewith.

At the interface between the first stage compressor outlet 18 and the second stage compressor inlet 20, that is, at an interface point 24, a bleed air line 26 is provided for purposes to be seen.

Returning to the second stage compressor 22, the same has an outlet 28 which is adapted to provide compressed air to a combustor 30 in a conventional fashion. A controlled flow of fuel is provided to the combustor on a line 32 and a means for igniting fuel in the combustor 30 is schematically provided at 34.

As is well-known, the combustor 30 includes an outlet 36 for hot gases of combustion, and usually dilution air as well. This outlet 36 is connected to a nozzle 38 in proximity to a turbine wheel 40 which is on the shaft 10 and is operative to drive the same to thereby drive the first and second stage compressors 12 and 22.

An exhaust 42 from the turbine wheel 40 is provided and within the exhaust 42 is an exhaust gas temperature sensor 44 utilized for purposes to be seen.

The end of the shaft 10 remote from the turbine wheel 40 is connected to a gear box 46 to provide an input thereto. The gearbox 46 includes an output 48 to a variable load 50 which may be one or more of an electrical generator, hydraulic pump, etc. The gear box 46 also provides a means for driving a fuel pump and fuel control system 52 connected to receive fuel on a line 54 and expel the same in a controlled fashion on the line 32 to the combustor 30.

Also associated with the gear box 46 is a conventional starter 56, such as an air starter, hydraulic starter or an electric starter, for the engine.

Figure 2:
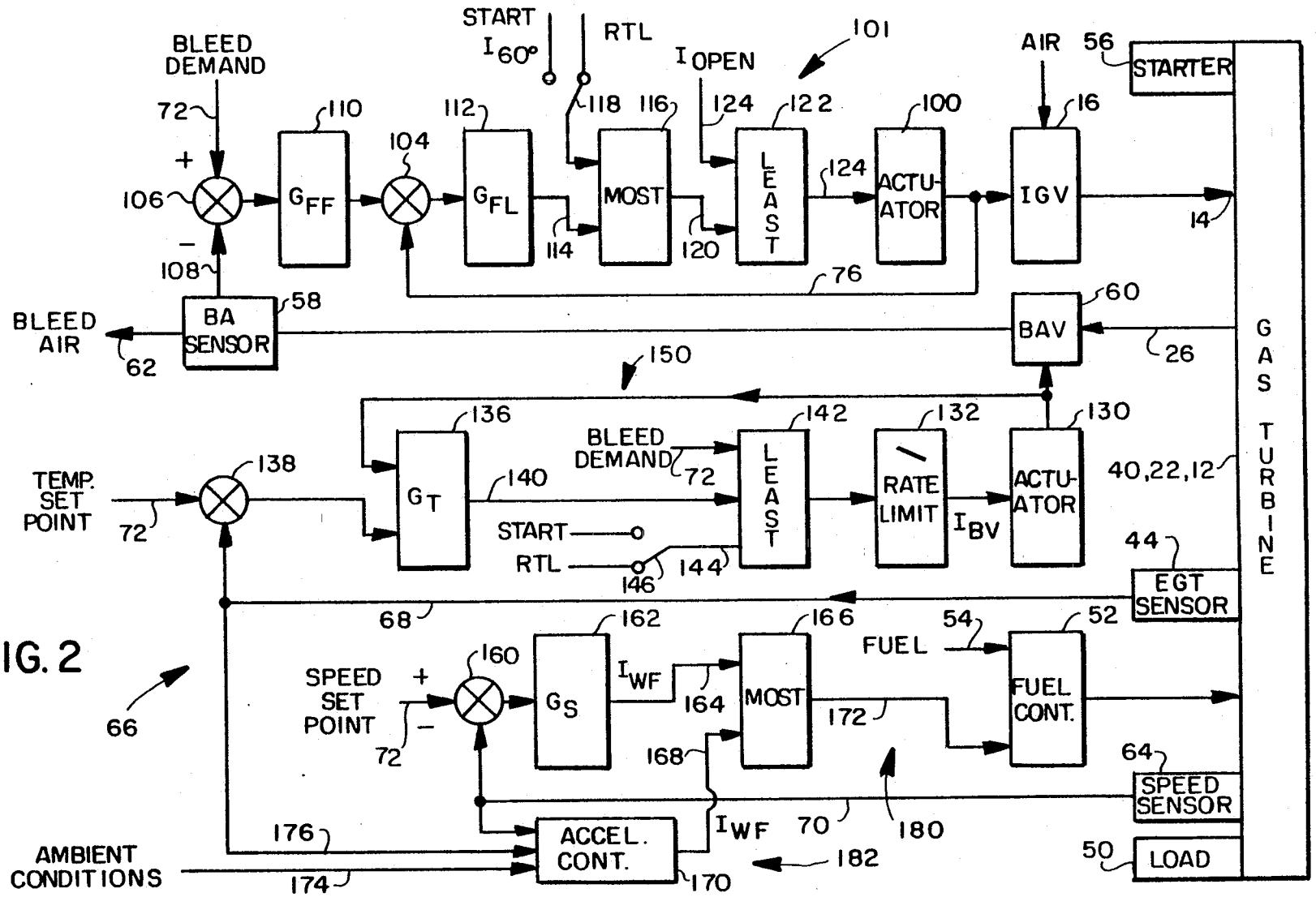
FIG. 2 is a somewhat more detailed block diagram of the invention.

A bleed air flow sensor 58 is interposed in the line 26 between the interface point 24 between the first and second stage compressors 12 and 22 and a modulating bleed air valve 60 which controls the flow of bleed air on a line 62 to a point of use (not shown). However, the sensor 58 can be downstream of the valve 60 if desired as shown in FIG. 2.

An engine shaft speed sensor 64 is coupled to the shaft 10 in any suitable fashion for purposes to be seen and provides a shaft speed signal.

The system is completed by a controller, generally designated 66, which controls the overall operation. The controller 66 includes an input line 68 connected to the exhaust gas temperature sensor 44 as well as an input line 70 connected to the shaft speed sensor 64. External command signals are provided to the controller 66 by an input line 72 and system status information and communication signals may be outputted on a line 74.

A signal indicative of the position of the inlet guide vanes 16 may be provided to the controller 66 on a line 76 and a fuel control signal outputted on a line 78 to the fuel pump and control 52.

Turning now to FIG. 2, the controller 66 will be explained in greater detail. Associated with the inlet guide vanes 16 is an actuator 100 which is in the form of any suitable type of motor and which typically will be operative to move the inlet guide vanes from one position at approximately 60° to the radial past 0° to as many as −15° to the radial, that is 15° to the opposite side of the radial. The actuator 100 is in an inlet guide vane control servo, generally designated 101. The control servo 101 includes a position feedback loop represented in part by the line 76. Any suitable transducer for generating a feedback signal may be utilized and may be connected to the output of the actuator 100 or, if desired, to the inlet guide vanes 16 themselves. Either connection will be satisfactory so long as the signal provided on the line 76 is representative of the actual position of the inlet guide vanes.

This signal is fed to a summing junction 104 for purposes to be seen.

A summing junction 106 receives a bleed air demand signal as one of the inputs on the line 72 as well as a bleed air flow signal on a line 108. The bleed air demand signal may be selected to be variable to set a demand or may simply be a set point signal if desired. The bleed air flow signal is generated by the bleed air sensor 58 and is indicative of the actual bleed air flow through the bleed air valve 60.

The error between the two, if any, is provided to a signal conditioner and control algorithm circuit 110 which in turn provides an output signal to the summing junction 104 which is related to the error at the summing junction 106, as modified by any control algorithm that one desires to employ. The selection of a control algorithm and the inclusion thereof may be achieved as conventionally known in the art.

The output of the circuit 110 will then be summed with the feedback signal representative of inlet guide vane position at the summing junction 104 and the error signal thereat, if any, inputted to a signal conditioner end control algorithm circuit 112. The output from the circuit 112 is placed on a line 114 and the same will be related to the error at the summing junction 104 as modified, if at all, by the control algorithm implemented by the circuit 112. This signal is placed on one input to a so-called "MOST" gate 116. A second input to the gate 116 may be taken from an electronic switch shown schematically at 118 which may be configured to receive a system start signal when it is desired to start the turbine or a system ready to load (RTL) signal when the turbine has been accelerated to a speed whereat it is ready to receive a load. In the case of the former, the inlet guide vanes are moved towards a closed position, which in this case corresponds to a position approximately 60° to the radial, hence the designation for one side of the switch 18 as $I_{60}$. The ready to load condition is given the designation "RTL". The MOST gate 116 will provide, as an output on a line 120, a signal equal to the larger of the input signals and such a signal is provided to a so-called LEAST gate 122. A second input to the gate 122 is connected to any suitable source of an $I_{OPEN}$ signal on a line 124. The $I_{OPEN}$ signal is a signal that is selected to limit the degree to which the inlet guide vanes may be opened.

The LEAST gate 122, in turn, is operative to provide a signal on a line 124 as an input to the actuator 100 which is a signal related to the difference between the actual position of the inlet guide vanes 16 and that desired as a result of whether a system start condition is in existence, the turbine is in a ready to load condition, a limitation on the opening of the vanes is in vogue as a result of the magnitude of the $I_{OPEN}$ signal, a change in the inlet guide vane geometry is required as a result of bleed air flow and/or a change in bleed air demand. The overall bleed air control servo 100 is such that, in normal operation, the inlet guide vanes will be progressively moved towards a closed position as bleed air flow is reduced to prevent compressor surge.

The system also includes an actuator 130 for controlling the position of or modulating the bleed air valve 60. The actuator 130 is controlled by the output signal from a rate limiting circuit 132. The rate limiting circuit is designed to limit the rate at which the actuator 130 may close the bleed air valve 60 so that the same does not close faster than the inlet guide vane servo control 101 can correct the position of the inlet guide vanes 16.

A position feedback line 134 is connected either to the bleed air valve 60 or to the output of the actuator 130 to provide a signal representative of the actual position of the bleed air valve 60. This signal is placed as an input to a signal conditioning, control algorithm and comparator circuit 136 along with an error signal derived from a summing junction 138. One input to the summing junction 138 is a temperature set point which may be taken from the input line 72 while the second is from the line 68 which, it will be recalled, is connected to the exhaust gas temperature sensor 44 and provides a signal representative of the exhaust gas temperature.

The circuit 136 thus provides an output related to the error signal, if any, from the summing junction 136 and the actual position of the bleed air valve as modified by any desired algorithm. This output signal is placed on a line 140 as an input to a LEAST gate 142 whose output is in turn connected to the rate limiting circuit 132.

A variable bleed demand signal from the line 72 is a second input to the LEAST gate 142 while a third may be received on a line 144 which is connected to an electronic switch 146 that, like the switch 118, may provide input signals relative to a system start condition or a system ready to load condition. Thus, a bleed air valve control servo, generally designated 150 including a feedback loop provided by the line 134 which is also responsive to exhaust gas temperature to prevent overtemperature is defined.

The system also includes a speed control circuit. In typical uses of gas turbines of this sort, a substantially constant speed operation is desired and consequently, a speed set point signal is provided on the input line 72 to a summing junction 160. The actual speed of the gas turbine is determined by the speed sensor 64 and the resulting actual speed signal placed on the line 70 is also fed to the summing junction 160. The resulting error signal, if any, is fed to a signal conditioning and control algorithm circuit 162 so that the error, if any, between the commanded speed and the actual speed, as modified by the control algorithm, is provided as an output on a line 164 to a LEAST gate 166. A second input to the LEAST gate 166 is taken from a line 168 which is connected to the output of an acceleration control circuit 170. The LEAST gate 166 is thus operative to provide an output signal that is the lesser of one related to the error between commanded speed and actual speed and an acceleration command signal received from the acceleration control circuit 170. This output signal is placed on a line 172 and provided to the fuel pump and control 52 to control the flow of fuel through the line 54 to the gas turbine.

The acceleration control circuit 170 includes a first input on a line 174 which, in fact, may be several inputs designating various ambient conditions as is well-known. For example, the ambient air temperature will typically be one such condition. A second input to the acceleration control circuit 170 is received on a line 176 which in turn is connected via the line 68 to the exhaust gas temperature sensor 44. This input is processed within the acceleration control circuit 170 so as to prevent any command from being issued which would result in overtemperature conditions existing within the engine.

A third input is taken from the line 70 and thus represents the sensed speed of the gas turbine. Thus, the controller 66 additionally includes a speed control, generally designated 180, and including the summing junction 160, the circuit 162, the gate 166 and the fuel pump and control 52 as well as an acceleration control system, generally designated 182, which includes the acceleration control circuit 170 and the various input lines 70, 174 and 176 thereto.

To initiate operation of the engine, the following sequence will typically be employed. The inlet guide vane control servo 100 will command the inlet guide vanes 16 to assume a closed condition and the gas turbine will be cranked by suitable operation of the starter 56.

Under cranking, the speed of the shaft 10 (FIG. 1) will be increased until ignition speed is obtained. At this point, fuel will be caused to flow to the engine by the fuel pump and control 52 and the ignition system 34 (FIG. 1) turned on.

The acceleration control system 182 will be operative to control fuel flow to accelerate the gas turbine up to operating speed. This operation of the acceleration control system 182 can be scheduled based on turbine speed and ambient conditions, various closed loop considerations which may include exhaust gas temperature or the like. Once operating speed is reached as determined by the speed sensor 64, loading the turbine either by adding the load 50 or by the taking of bleed air on the line 62 from the junction between the first and second stage compressors 12 and 22, or combinations thereof, may be accomplished. In some instances, it may be desirable to provide a means for limiting bleed air flow through the valve 60 where power to the load 50 is a first priority.

In general, the acceleration control system 182 is used solely during the acceleration of the gas turbine from start initiation until the same reaches the ready to load (RTL) speed. The acceleration control system 182 is operative to control fuel flow at this time to ensure rapid, reliable acceleration while avoiding exceeding the limiting conditions of gas turbine operations such as overtemperature and surge.

The speed control 180 is the basic fuel control of the gas turbine engine after the RTL condition is reached. It is operative to maintain speed within acceptable limitations for the particular application as the gas turbine is subject to varying shaft load and bleed load loading conditions as well as varying ambient conditions.

The bleed air control 150 is basically employed to control the flow of bleed air with the rate limiting circuit 132 being such as to prevent the bleed valve 60 from closing faster than the inlet guide vanes 116 can correct their position so as to avoid surge. Finally, the inlet guide vane control servo 100 is employed to control the positioning of the inlet guide vanes 16 during start and thereafter as a function of the measured bleed air flow once RTL speed is achieved.

From the foregoing, it will be appreciated that a gas turbine engine and control system made according to the invention is ideally suited for use in those applications where the turbine is subjected to varying shaft and bleed air loading and where stable operation and the avoidance of surge provide a high degree of reliability is needed.

We claim:

1. A turbine engine and control system therefor comprising:

a turbine engine adapted to be coupled to a load and including interconnected first and second stage compressors, a turbine wheel connected in driving relation thereto, an exhaust from said turbine wheel, a combustor interposed between the turbine wheel and the second stage compressor, and variable inlet guide vanes at the inlet to said first stage compressor;

means defining a controllable bleed air flow path connected between said first and second stage compressor and including a bleed air flow sensor associated therewith;

a fuel system including a fuel flow control for providing fuel to said combustor to be combusted therein;

a turbine wheel speed sensor connected to said turbine engine;

means for moving said inlet guide vanes between open, closed and intermediate positions;

means for sensing the position of said inlet guide vanes and for providing a signal representative thereof;

means for providing a variable bleed air signal to command varying bleed air flows;

means responsive to said bleed air signal for operating said controllable bleed air flow path to provide the commanded varying bleed air flows; and means responsive to said bleed air flow sensor for causing said moving means to move said inlet guide vanes between the positions thereof to prevent surge in response to decreases in bleed air flow.

2. The turbine engine and control system of claim 1 wherein said bleed air flow path includes a modulating valve and further including rate limiting means for preventing said modulating valve from closing at a rate faster than said moving means can move said inlet guide means to a corrected position for the resulting change in bleed air flow.

3. The turbine engine and control system of claim 1 including an exhaust gas temperature sensor associated with said exhaust and for providing an exhaust gas temperature signal, said means for operating sid controllable bleed air flow path further being responsive to said exhaust gas temperature signal.

4. The turbine engine and control system of claim 3 wherein said bleed air flow path defining means includes a modulating valve and said means for operating said controllable bleed air flow path includes a position feedback servo loop connected to said modulating valve.

5. The turbine engine and control system of claim 4 wherein said first stage compressor is a high specific speed compressor having an $N_s \geqq 100$ wherein $$N_s = \frac{N\sqrt{CFS}}{(H_{ad})^{.75}}$$

and N=rpm of the first stage compressor,

CFS=first stage compressor inlet, volumetric flow rate is $ft^3$/second, and $H_{ad}$=adiabatic head in ft.

6. An integrated bleed load compressor system comprising:

a rotatable shaft adapted to drive a variable load;

a high specific speed first stage centrifugal compressor on said shaft;

a second stage compressor on said shaft and having an inlet connected to the outlet of said first stage compressor to define an interface;

a modulating bleed air valve, including an actuator, connected to said interface;

variable inlet guide vanes at the inlet to said first stage compressor;

a combustor connected to the outlet of said second stage compressor and including a fuel inlet to receive fuel to be combusted;

a turbine wheel on said shaft and disposed to receive hot gases of combustion from said combustor;

an exhaust from said turbine wheel;

means for driving said inlet guide vanes between open, closed and intermediate positions and providing an inlet vane position feedback signal;

means associated with said exhaust for providing an exhaust gas temperature signal;

means for providing a bleed air demand signal;

means for providing a bleed air modulating valve position feedback signal;

a bleed air valve servo control for said actuator and responsive to said exhaust gas temperature, bleed air demand and modulating valve position feedback signals for controlling operation of said actuator to place said modulating valve in a desired condition;

a bleed air flow sensor for sensing bleed air flow through said modulating valve and providing a bleed air flow signal; and an inlet guide vane servo control for said driving means and responsive to said inlet guide vane position feedback, bleed air demand and bleed air flow signals for placing said inlet guide vanes in desired positions thereof.

7. The integrated bleed load compressor system of claim 6 further including means for conditioning both said servo controls for system start and system ready to load conditions.

8. The integrated bleed load compressor system of claim 7 further including a grating system in said bleed air valve servo control including a rate limiting circuit for limiting the rate at which said bleed air valve may be modulated.

* * * * *